US010808997B2

(12) United States Patent
Simdyashkin

(10) Patent No.: US 10,808,997 B2
(45) Date of Patent: Oct. 20, 2020

(54) METHOD OF REFRIGERANT COMPOSITION CONTROL IN PREMIXED REFRIGERANT CYCLE OF LIQUEFIED NATURAL GAS PRODUCTION

(71) Applicant: Sakhalin Energy Investment Company Ltd., Hamilton (BM)

(72) Inventor: Igor Evgenievich Simdyashkin, Yuzhno-sakhalinsk (RU)

(73) Assignee: SAKHALIN ENERGY INVESTMENT COMPANY LTD., Hamilton (BM)

( * ) Notice: Subject to any disclaimer, the term of this patent is extended or adjusted under 35 U.S.C. 154(b) by 0 days.

(21) Appl. No.: 16/385,153

(22) Filed: Apr. 16, 2019

(65) Prior Publication Data

US 2020/0018543 A1 Jan. 16, 2020

(30) Foreign Application Priority Data

Jul. 13, 2018 (RU) ..... 2018125814

(51) Int. Cl.
*F25J 1/02* (2006.01)
*F25J 1/00* (2006.01)

(52) U.S. Cl.
CPC ..... *F25J 1/0252* (2013.01); *F25J 1/0055* (2013.01); *F25J 1/0222* (2013.01); *F25J 1/0249* (2013.01);
(Continued)

(58) Field of Classification Search
CPC ..... F25J 1/0252; F25J 1/0055; F25J 1/0222; F25J 1/0249; F25J 1/0254; F25J 1/0092; F25J 1/0022
(Continued)

(56) References Cited

U.S. PATENT DOCUMENTS 5,139,548 A * 8/1992 Liu ..... F25J 1/0022 62/611
10,215,487 B2 * 2/2019 Nemov ..... F25J 1/0212
2018/0209724 A1 * 7/2018 Repasky ..... F25J 1/0269

FOREIGN PATENT DOCUMENTS

CN 202675795 U 1/2013
RU 2060431 C1 5/1996
(Continued)

OTHER PUBLICATIONS

Extended European Search Report dated Mar. 13, 2020, from corresponding European Application 19183671.7.
(Continued)

*Primary Examiner* — Joel M Attey
(74) *Attorney, Agent, or Firm* — Ladas & Parry LLP

(57) ABSTRACT

A method for controlling the refrigerant composition in a pre-cooled mixed refrigerant (PMR) cycle for LNG production includes obtaining a weather forecast temperature, measuring the concentration of each PMR component and measuring the ambient temperature. The method further includes calculating the optimum concentration of each PMR component for each of the measured and weather forecast temperatures and calculating the time period required to change appropriately each component concentration in transition from the ambient temperature to the weather forecast temperature; and comparing the measured and optimum concentration of each component in view of the calculated time period and direction of change in the component concentrations during the time period.

4 Claims, 2 Drawing Sheets

(52) U.S. Cl.
CPC ..... *F25J 1/0022* (2013.01); *F25J 1/0092* (2013.01); *F25J 1/0254* (2013.01)

(58) Field of Classification Search
USPC ..... 62/612
See application file for complete search history.

(56) References Cited

FOREIGN PATENT DOCUMENTS

| | | | |
|---|---|---|---|
| RU | 2571697 | C2 | 4/2013 |
| WO | WO2010/055153 | A1 | 5/2010 |
| WO | 2012/125018 | A1 | 9/2012 |

OTHER PUBLICATIONS

English translation of the relevant portion of E. B. Fedorova «State-of-the-art and 15 development of the global liquefied natural gas industry: technologies and equipment», Moscow: I. M. Gubkin Russian Oil and Gas University, 2011, p. 80-82.
RU2060431 English Translation.
Decision to Grant a Patent dated Oct. 16, 2019 for RU 2018 125814.
English Translation of Decision to Grant a Patent dated Oct. 16, 2019 for RU 2018 125814.
Official action dated Feb. 26, 2019 for RU 2018 125814.
English Translation of Official action dated Feb. 26, 2019 for RU 2018 125814.

* cited by examiner

METHOD OF REFRIGERANT COMPOSITION CONTROL IN PREMIXED REFRIGERANT CYCLE OF LIQUEFIED NATURAL GAS PRODUCTION

FIELD OF THE INVENTION

The invention relates to compression refrigerator control systems in premixed refrigerant cycle of liquefied natural gas production.

BACKGROUND OF THE INVENTION

WO 2012125018 discloses a method for controlling the natural gas liquefaction process in a mixed refrigerant unit, which method comprises periodical monitoring of the current process parameters and controlling the refrigerant composition in a main cryogenic heat exchanger (MCHE) for achieving the optimum process parameters. This method primarily uses an «instruction control system» as a program code providing maintenance of the desirable MCHE temperature profile.

The disadvantages of the known method are insufficient control accuracy and speed in the rapidly changing ambient temperature conditions. Furthermore, the known method provides natural gas liquefaction using a single mixed refrigerant circuit.

The natural gas liquefaction technology with a double mixed refrigerant (DMR), as disclosed, for example, in the monograph of E. B. Fedorova «State-of-the-art and development of the global liquefied natural gas industry: technologies and equipment», Moscow: I. M. Gubkin Russian Oil and Gas University, 2011, p. 80-82, uses two streams of circulating mixed refrigerant: in the pre-cooling circuit and in the liquefying circuit. FIG. 1 represents a simplified scheme of liquefied natural gas production according to DMR technology. As is shown in FIG. 1, a premixed refrigerant (PMR) is compressed in a two-stage air-cooled compressor C3 and fed to the tube nest of a heat exchanger HE1. At the HE1 outlet, PMR is split into two streams. The first stream is throttled in T5 and fed to the HE1 annulus for cooling the streams passing up the tube nests. The second stream is fed to a heat exchanger HE2 for further cooling, throttling in T4 and forming the HE2 cooling stream. The HE1 and HE2 bottom effluent gas streams are fed to C3.

The purified natural gas and mixed refrigerant (MR) of the main liquefaction cycle are cooled in the pre-cooling cycle to the temperature between −50 and −80° C. serially passing up the HE1 and HE2 tube nests.

MR consisting primarily of methane and ethane with some content of propane and nitrogen is cooled in HE1 and partially condensed in HE2, then split in a separator S1 into two streams (liquid and gas) passing up to the HE3 tube nests. The main liquefaction cycle refrigerant is removed from HE3 bottom, and fed for suction to a two-stage compressor C1,2, where it is compressed, cooled, and returned to HE1.

In MCHE (HE3), the natural gas is passed up the tube nests, liquefied, and supercooled to −153° C. After the MCHE, the compressed and liquefied gas is expanded in T1 to 0.12-0.13 MPa, cooled to −101° C., and fed to a storage vessel.

The pre-cooled mixed refrigerant (PMR) is a mixture of ethane and propane with a slight content of methane. Use of mixed refrigerant in the pre-cooling cycle makes the process more flexible and effective in the low temperature conditions of ambient air. The process can be readily adapted to the changing ambient temperature by varying the PMR component ratio.

However, the refrigerant composition control for minimizing the PMR cycle temperature with respect to the current ambient temperature is extremely difficult due to a limited vapor make-up rate. For such great volume of PMR cycle, limited vapour make-ups leads in limited rate of changing PMR composition. Due to the optimum PMR composition changing along with the ambient temperature and limited rate of changing PMR composition even at the daily temperature fluctuations, the composition will be often far from optimum.

The technical problem, which is be solved by the invention, is to develop a method for controlling the pre-cooled mixed refrigerant composition, which method allows optimizing the PMR composition via accurate and stable control. The technical result is higher efficiency of the pre-cooling cycle due to maintaining the optimum PMR composition and thus minimizing the cooled product temperature in LNG production

SUMMARY OF THE INVENTION

The given problem is solved and the technical result is achieved by the method for controlling the refrigerant composition in the PMR cycle of LNG production, wherein control is carried out in view of the weather forecast temperature, and the method comprises the steps of measuring the concentration of each PMR component; measuring the ambient temperature; calculating the required concentration of each component for each of the measured and weather forecast temperatures on the basis of the predetermined relationship between the optimum concentration of each component and ambient temperature; calculating the time period required to change appropriately each component concentration in transition to the following of the weather forecast temperatures by using the highest possible change (increase or decrease) rate of each component concentration for the said cycle; and comparing the measured and required concentration of each component in view of the calculated time periods and direction of change in the component concentrations during these periods.

The increasing concentration of a PCR component is accomplished by inserting make-up of this component into the cycle, and the decreasing concentration of a PCR component is accomplished by inserting make-up of other components into the cycle.

The PMR components are methane, ethane, and propane.

The daily weather forecast is preferably obtained along with the temperature data every hour.

Preferably, the time periods, which are selected from the periods, exceed the time period between two adjacent temperature values from the weather forecast, and the measured and required concentrations of each component are compared in view of the selected time periods.

The invention is explained with figures.

DETAILED DESCRIPTION

The major objective of controlling the PMR composition is minimizing the cycle temperature in view of the current ambient temperature. Thus, minimized temperature is the temperature of natural gas (NG) leaving the PMR cycle. Further, it indicates the work saved in the MR cycle of NG liquefaction that allows for the same maximum load of MR compressor to produce more product (i.e. to liquefy more NG).

Figure 1:
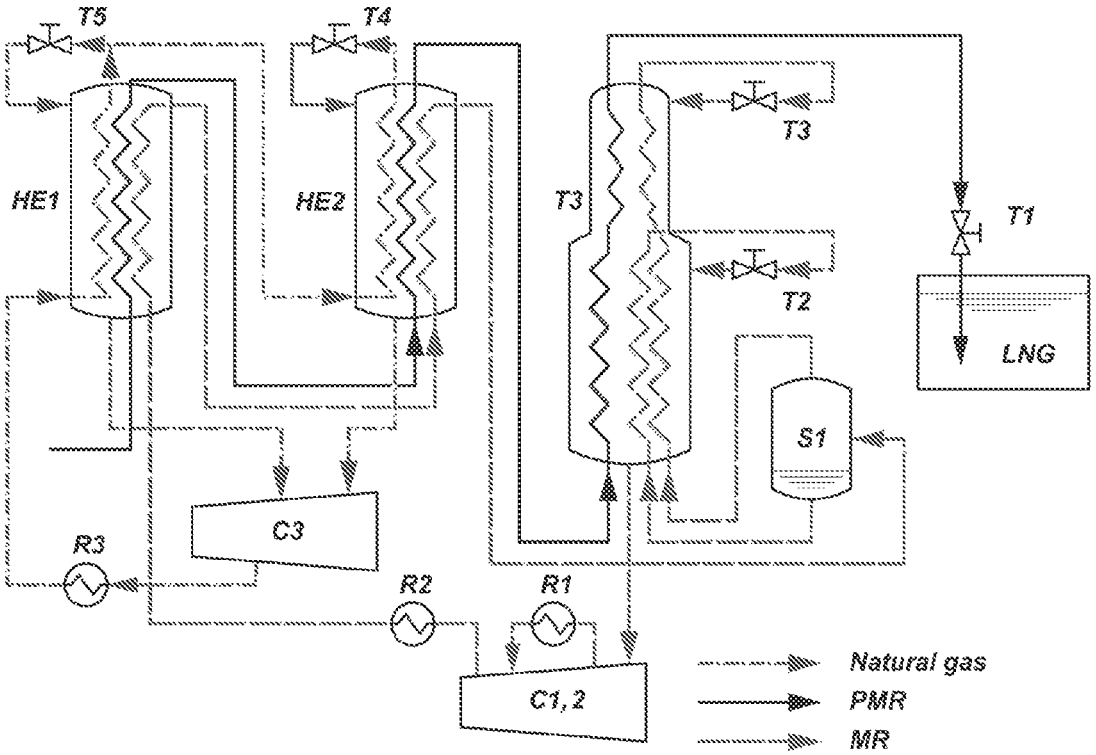
PRIOR ART FIG. 1
FIG. 1 depicts the simplified scheme of LNG production according to DMR technology.

It should be understood that the lighter is the PMR composition, the more effective is the PMR cycle since heat exchangers HE1 and HE2 (FIG. 1) achieve a lower temperature at a lower pressure according to the phase diagrams. On the other hand, however, a lighter PMR composition increases the pressure in separator S1, and PMR compressor needs a higher power since the PMR volume is greater for the same weight, and it is essential that the PMR compressor auxiliary motor (not shown) is not switched from power generating to power consuming mode (this switch negatively affects the total process efficiency by overweighting the gain from lighter PMR composition). The PMR compressor auxiliary motor is required to utilize the excess power generated by a gas turbine (provisionally not shown) in C3 rotation or, vice versa, to assist to the gas turbine if the power is insufficient for maintaining the set compressor rotation frequency. To maximize production, the power for MR and PMR auxiliary motors is provided by the Common power system; however, the given power is limited and totally consumed by the MR compressor auxiliary motor both from the common mains and from the PMR compressor auxiliary motor. For this reason, it is necessary to maintain the PMR compressor auxiliary motor in the power generation mode by keeping the optimum PMR composition. The turbine power is also variable and depends, in particular, on the air temperature. The higher is the ambient temperature, the lower is the power generated by turbines.

Therefore, the optimum temperature of PMR components depends upon the ambient temperature. This dependence for each of the PMR components may be obtained experimentally for the particular LNG production unit.

It is essential to note that a preferable PMR cycle comprises make-up the components, i.e. to decrease the concentration of any PMR component, two others should be added. The PMR components may be added by opening the make-ups. Ethane and propane may use both gas and liquid make-ups, while methane may be added only as a gas. In the make-up process, excess liquid creating excessive level in the separator (provisionally not shown) at C3 outlet is drained (to a fractionating unit) that further promotes to lower concentration of the component, while other components existing in the gas phase in the same separator (primarily, methane) create excessive pressure and removed to MR cycle.

The ambient temperature may significantly vary, especially in autumn and spring, when the temperature drop may be up to 15° C. in a short period of time. For this reason, controlling the PMR composition only in view of the current ambient temperature with respect to the limited PMR composition change rate leads in a non-optimum PMR composition.

To achieve or at least approach to the optimum concentrations of PMR components, controlling the PMR composition according to the invention is carried out in view of the weather forecast temperatures.

The weather forecast is preferably provided as the hour temperature data in advance for 24 hours, e.g. from 5 a.m. to 5 a.m. of the next day. The weather forecast may be updated each 12 hours.

The concentration of each PMR component and ambient temperatures are measured to calculate the required concentration of each component for each of the measured and weather forecast temperatures on the basis of the predetermined relationship between the optimum concentration of each component and ambient temperature.

Figure 2:
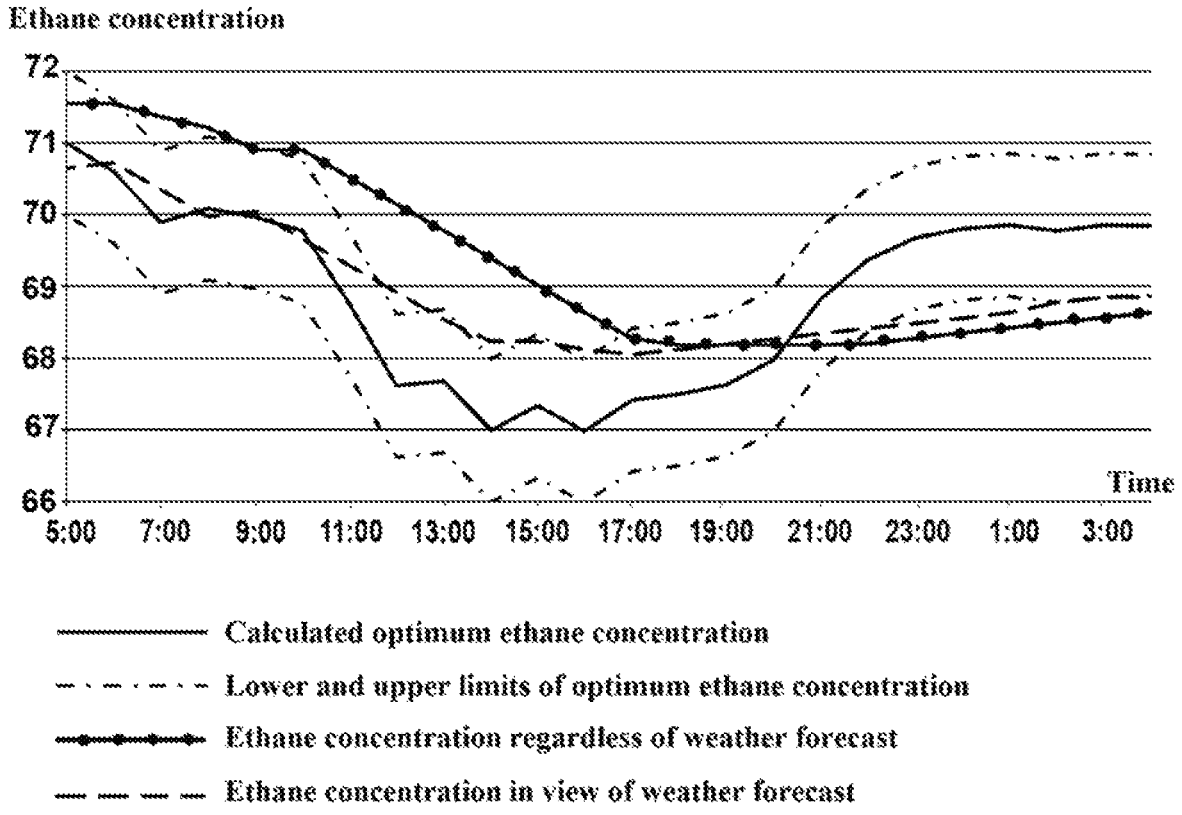
FIG. 2 depicts the time plots of calculated ethane concentration, ethane concentration in PMR controlled regardless of weather forecast and in view of weather forecast according to the invention.

FIG. 2 depicts an example of the calculated ethane concentration vs. time in view of permissible 1% deviations.

Then for each of the weather forecast temperatures the required time period is calculated to change (increase or decrease) appropriately each component concentration in transition to the following weather forecast temperature, in particular, to the next hour temperature, by using the PMR cycle with the maximum possible change (increase or decrease) rate of each component. The said rates may be calculated or determined experimentally.

The time periods, which are selected from the calculated periods, exceed the period between two adjacent weather forecast temperature values, in particular, the periods exceeding 1 hour (for the hourly weather forecast).

Then the measured concentration of each component is compared to the required one and each component concentration is varied in view of the selected time periods and the direction of changing the component concentrations during these periods.

For this purpose, it is necessary to calculate the excess of the selected tune periods over the time period 1 hour) between two adjacent weather forecast temperatures, and the relevant component concentration measuring is started in advance with respect to the said excess as welt as to the direction of the component concentration change, where the comparison with the required concentration is carried by using either the lower or upper permissible limit thereof.

As shown in FIG. 2, the refrigerant composition in the PMR cycle, in particular, for ethane, is controlled by the inventive method as compared to the controlling regardless of the weather forecast that allows achieving the ethane concentration far less extending beyond the permissible limits of its optimum concentration.

The invention claimed is:

1. A method for controlling refrigerant composition comprising pre-cooled mixed refrigerant (PMR) components in a cycle of liquefied natural gas (LNG) production in an LNG production unit, the method comprising the steps of:

measuring a concentration of each of the PMR components;

measuring an ambient temperature to obtain a measured ambient temperature;

obtaining a weather forecast comprising at least one weather forecast temperature for a future time;

calculating an optimum concentration of each of the PMR components for each of the measured ambient temperature and the weather forecast temperature based on a predetermined relationship between the optimum concentration of each of the PMR components and potential temperatures;

calculating a time period required to change the concentration of each of the PMR components in a transition from the optimum concentration of each of the PMR components for the measured ambient temperature to the optimum concentration of each of the PMR components for the at least one weather forecast temperature in the LNG production unit;

comparing the optimum concentration of each of the PMR components for the measured ambient temperature and the optimum concentration of each of the PMR components for the at least one weather forecast temperature; and, based on the comparing, changing the concentration of each of the PMR components to transition from the optimum concentration of each of the PMR components for the measured ambient temperature to the optimum concentration of each of the of components for the at least one weather forecast temperature in the LNG production unit during the time period, wherein the changing of the concentration of each of the PMR components is achieved by preferentially supplying make-up amounts of select of the PMR components to increase or decrease relative concentrations of the PMR components.

2. The method of claim 1 wherein the PMR components are methane, ethane, and propane.

3. The method of claim 1, wherein the weather forecast comprises the at least one weather forecast temperature and a second weather forecast temperature that comprises a prediction of a weather forecast temperature value for a time that is further in the future than that of the at least one weather forecast temperature, and wherein the method comprises calculating a further time period required to change appropriately in both an upward and downward direction the concentration of each of the PMR components in the LNG unit for a transition from the optimum concentration of each of the PMR components for the at least one weather forecast temperature to an optimum concentration of each of the PMR components for the second weather forecast temperature.

4. The method of claim 3, wherein the further time period exceeds a duration between respective future times represented by the at least one weather forecast temperature and the second weather forecast temperature.

* * * * *